United States Patent [19]

Meehan

[11] Patent Number: 4,998,621

[45] Date of Patent: Mar. 12, 1991

[54] PACKAGE FOR A LIQUID SAMPLE AND AN ASSOCIATED METHOD FOR PACKAGING A LIQUID SAMPLE

[76] Inventor: Frank Meehan, 203 Cathedral Ave., Hempstead, N.Y. 11550

[21] Appl. No.: 526,829

[22] Filed: May 22, 1990

Related U.S. Application Data

[63] Continuation-in-part of Ser. No. 392,343, Aug. 11, 1989, Pat. No. 4,941,574.

[51] Int. Cl.[5] ..... B65D 75/28

[52] U.S. Cl. ..... 206/466; 53/449; 53/455; 206/484; 206/632

[58] Field of Search ..... 53/412, 449, 455; 206/45.31–45.34, 461–466, 632, 633, 484

[56] References Cited

U.S. PATENT DOCUMENTS

| | | | |
|---|---|---|---|
| 2,195,577 | 4/1940 | Miles | 206/461 |
| 2,463,992 | 3/1949 | Moore | 206/466 |
| 2,780,353 | 2/1957 | Volckening | 206/466 |
| 2,956,677 | 10/1960 | Kavadlo et al. | 206/464 |
| 3,185,295 | 5/1965 | Crane, Jr. | 206/45.31 |
| 3,333,684 | 8/1967 | Martelli | 206/45.31 |
| 3,334,804 | 8/1967 | Watts, Jr. | 206/45.31 |
| 3,853,220 | 12/1974 | Luray | 206/466 |
| 3,857,487 | 12/1974 | Misslin | 206/463 |
| 3,917,116 | 11/1975 | Mason | 206/631 |
| 4,430,843 | 2/1984 | Favale | 206/463 |

FOREIGN PATENT DOCUMENTS

| | | | |
|---|---|---|---|
| 0265999 | 5/1988 | European Pat. Off. | 206/632 |
| 6000590 | 8/1979 | PCT Int'l Appl. | 206/632 |

*Primary Examiner*—Jimmy G. Foster
*Attorney, Agent, or Firm*—Ladas & Parry

[57] ABSTRACT

A package and packaging method for a flowable sample such as perfume, lipstick, etc. in which the sample is sealed in a flexible envelope of film material and the envelope is in turn supported by a protective enclosure having greater rigidity than the envelope. The envelope is engaged around a portion of its perimetral extent to leave the envelope exposed outside the engaged portion and free and unsupported along the remaining portion of its perimetral extent. The envelope has a sealed pocket in which the sample is contained and the pocket is receivable in an opening in the protective enclosure. The protective enclosure is thicker than the envelope so that if pressure is applied to the pocket it will enter the opening, and be recessed and confined between the outer surfaces of the protective enclosure. The envelope can be removed in intact sealed state from the enclosure by manually engaging the exposed portion and pulling with sufficient force to overcome a detachable connection of the envelope to the enclosure. The pocket of the envelope is opened by unpeeling the surrounding seal. In an alternative embodiment, the pocket is opened while the envelope remains secured to the enclosure.

35 Claims, 7 Drawing Sheets

PACKAGE FOR A LIQUID SAMPLE AND AN ASSOCIATED METHOD FOR PACKAGING A LIQUID SAMPLE

CROSS RELATED APPLICATION

This application is a continuation-in-part of application Ser. No. 392,343 filed Aug. 11, 1989. now U.S. Pat. No. 4,941,574.

FIELD OF THE INVENTION

The invention relates to a package for a liquid sample and to a method for packaging a liquid sample.

DESCRIPTION OF PRIOR ART

There are many circumstances in which it is desirable to furnish liquid samples to the general public in an amount sufficient to allow more than one application. Commonly, and despite very high cost, the liquid sample is contained in a small vial attached to a printed card and frequently distributed at points of sale. This type of sample is rarely used in direct mail because it requires special packaging at considerable additional expense.

It is known to furnish samples, for example of perfumes, as part of brand advertisements in magazines. Magazine samples are generally comprised of micro-encapsulated liquid in one of a number of formats that require suitable activation, such as rubbing, scratching, or tearing. In the course of delivery to the home, the magazine is subjected to handling which causes a large number of capsules to rupture, effectively prematurely activating any samples contained therein. Hence, when there are two or more different samples in the same magazine, it may not be possible to distinguish the individual odor of any one sample. Not only are the samples thereby rendered useless, but should the samples be activated to any great extent, the collective residue causes the entire magazine to smell.

Another major form of perfume promotion is enclosures in department store billing. These often include samples of the above-described micro-encapsulation type but also may be in "blotter" form. Namely, paper blotters are impregnated with liquid and then placed in a wrapper of cellaphane or plastic which prevents the liquid, but not the odor, from permeating the enclosure.

Heretofore, there has not been any satisfactory production of a package which will enable a liquid sample to be contained in a flat package in protected fashion so that it can be sent through the mail, for example, as a promotional item in a magazine.

In my earlier U.S. Pat. Nos. 4,567,613, and 4,633,533, I have disclosed various articles and methods for dispensing liquids but I have not disclosed any method or means whereby a small sample of liquid can be packaged in a liquid state in a package which is readily handled and which protects the sample.

In co-pending application Ser. No. 318,909, I have disclosed an article in which a liquid sample can be self-contained, however the article is capable of being crushed and allowing leakage of the sample.

SUMMARY OF THE INVENTION

An object of the invention is to provide a method in which a small liquid sample, such as a perfume, can be packaged for use by a person.

A further object of the invention is to provide a package for such a liquid sample in which the liquid is visible.

Yet another object of the invention is to provide a method by which the liquid sample is contained in a flexible envelope which has a protective enclosure which enables the package to be manually manipulated while isolating the package from application of squeezing forces on the envelope.

Another object of the invention is to provide a method in which the envelope containing the liquid sample can be readily disconnected from the enclosure.

Another object of the invention is to permit the easy opening of the envelope without spillage or misapplication of the liquid. According to a feature of the invention, the envelope can be opened by unpeeling one layer of the envelope from another.

Another object of the invention is to provide a method in which the liquid sample can be packaged in an inexpensive and simple manner.

Another object of the invention is to provide a package for a liquid sample which will be only a fraction of the cost of a glass or plastic vial.

Another object of the invention is to provide a package for a liquid sample in which the liquid sample is protected so that the package can be sent through the mail especially as an insert in a magazine without release of the liquid or its scent.

Another object of the invention is to provide a package in which the envelope containing the liquid sample is removed from the enclosure before the user opens the envelope to gain access to the liquid sample. Thereby, when the package is included as an insert in a magazine, no odor will be produced until the user removes and opens the envelope. Consequently, a number of sample can be sent together without any danger of commingling of odors thereby preserving the integrity of the samples.

A further object of the invention is to provide a package which is adapted to more viscous samples, such as lipstick.

In accordance with the above and further objects of the invention, a method is provided in which a fluid sample is sealed in an envelope of non-permeable film material and the envelope is supported by a protective enclosure having greater rigidity than the envelope by engaging the envelope around a portion of its perimetral extent to leave the envelope exposed outside the engaged portion and free and unsupported along its remaining perimetral portion, the protective enclosure being of a thickness so that the envelope will be recessed below the outer surfaces of the enclosure.

In further accordance with the invention, the envelope is removed from the enclosure by manually engaging the exposed portion of the envelope and pulling with sufficient force to overcome the support of the envelope by the enclosure.

In accordance with one embodiment of the invention, the envelope is supported within the enclosure by sandwiching the engaged portion of its perimetral extent between two layers of the material of the enclosure, said layers being flat and holding the envelope in flat coplanar relation with the enclosure.

A further object of the invention is to provide a package for a liquid sample in which the envelope containing the liquid sample will be accessible and at the same time protected so that it can be enclosed as a promotional item, for example, in a magazine.

The invention contemplates for this purpose a package which comprises a sealed envelope of non-odor permeable material sealably containing a liquid sample and protective support means detachably engaging said envelope around at least a portion of its perimetral extent for holding the envelope in a flat state recessed below outer surfaces of the support means. A free and unsupported remaining portion of the envelope is manually engageable for detachable removing the envelope from the support means. A free and unsupported remaining portion of the envelope is manually engageable for detachably removing the envelope from the support means.

If the liquid sample is to be visible, the envelope is made from a transparent plastic material.

The support means has an opening across which the envelope extends, and preferably the opening is in the form of a cutout so that the envelope with the liquid sample contained therein is visible and engageable in the cutout. Preferably, the envelope is confined so that it lies within the perimetral outline of the support means.

According to a particular feature of the invention, the support means comprises a substrate including opposed flaps which detachably secure the envelope therebetween in sandwiched condition along that portion of the perimetral extent of the envelope which is engaged by the support means. Preferably this represents a major portion of the perimetral extent of the envelope so that the minor portion of the perimetral extent of the envelope is the free and unsupported part.

The total thickness of the substrate where the flaps engage the envelope is greater than the combined thickness of the envelope and the liquid sample so that the envelope is recessed beneath the outer contour of the opposed flaps.

According to another embodiment of the invention, the envelope is formed by a flexible film material which is folded on and around the substrate and is fixed thereto. A detachable connection is formed in the film around the pocket containing the sample so that when the envelope is pulled by the user, it separates from the rest of the package in an intact sealed state.

According to another embodiment of the invention, the envelope is disposed on one surface of the substrate and the other surface of the substrate is bare and exposed.

According to yet another embodiment of the invention, the envelope can be opened in situ on the substrate without removal of the envelope from the substrate.

DETAILED DESCRIPTION OF PREFERRED EMBODIMENTS

Figure 1:
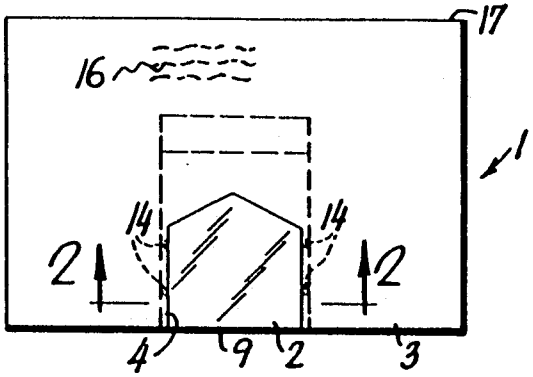
FIG. 1 is a plan view of a package for a liquid sample according to one embodiment of the invention.

In the drawing, there is seen a package 1 for a liquid sample which comprises a sealed envelope 2 containing the liquid sample itself and a protective enclosure or substrate 3 in which the envelope 2 is supported. The protective enclosure 3 is also of substantially flat configuration and is made of a material having substantially greater rigidity than that of the envelope 2. In one embodiment, the envelope 3 is made of a relatively thin transparent plastic material while the protective enclosure is a thicker substrate made of a more rigid material, such as cardboard or other heavy paper product.

Figure 2:
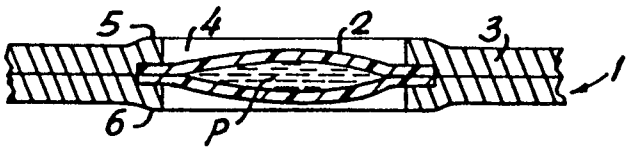
FIG. 2 is a sectional view on enlarged scale taken along line 2—2 in FIG. 1.

In the assembled state of the package as shown in FIGS. 1 and 2, the envelope 2 is engaged within and enclosed by the protective enclosure 3 in a condition in which a portion of the envelope 2 is visible through a cutout 4 formed in the enclosure. Due to the construction in which the protective enclosure is of greater thickness than the envelope, the outer surfaces 5 and 6 of the enclosure are spaced respectively above and below the envelope to provide protection for the envelope and its liquid sample. This will be explained more fully later.

Figure 3:
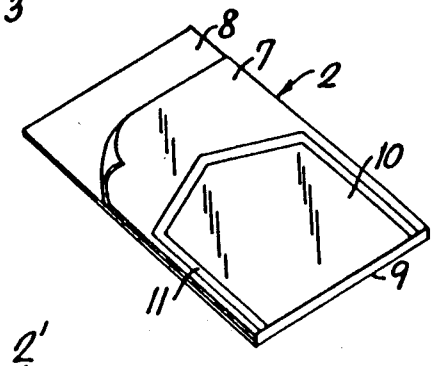
FIG. 3 is a perspective view on enlarged scale of a sealed envelope containing liquid used in the package.

The envelope is formed as shown in FIG. 3 by overlapping two flaps 7,8 on one another around a fold line 9. A pocket 10 for containing a liquid sample P in sealed relation is produced by sealing the overlapped flaps 7 and 8 along a seal line 11 formed by heat sealing the flaps along line 11. The seal line 11 extends from the fold line 9 along a path which corresponds to the outline of the cutout 4 in the enclosure. In the assembled state therefore, the pocket 10 will be exposed through the cutout 4. If the envelope 2 is made of transparent material, the liquid sample which is contained will be visible through the cutout.

The envelope can be made of any suitable plastic material which is non-permeable to liquids and their scents and is capable of being sealed. The choice is widespread, and those skilled in the art will readily be able to select appropriate materials for use depending on the nature of the liquid sample and the general requirement that the plastic material not interfere with the long term storage of the liquid sample nor impair the properties thereof. In the case of perfumes, it is important that the plastic material not interfere with the scent of the perfume. By way of example, the material of the envelope can be a polyethylene film sold by the 3-M Company under the trademark "Scotch-Pak #122". This material can be heat sealed along sealing line 11 and can be peeled open after heat sealing. This material is substantially impermeable to liquids and their odor and will not affect the scent of perfumes or like liquids when stored in the envelope.

Figure 4:
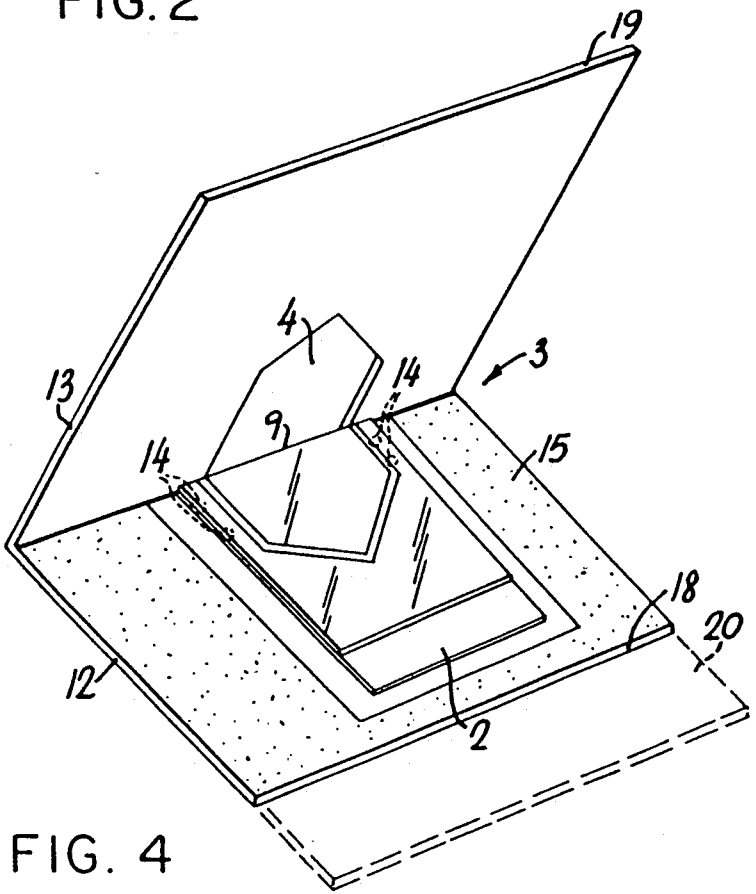
FIG. 4 is a perspective view showing an intermediate stage in the assembly of the package.

In order to assemble the package for use, the liquid sample is deposited onto the envelope in an amount which can be adsorbed by the envelope. The liquid sample is then sealed in the envelope 2 by folding the envelope along fold line 9 and forming the heat seal along line 11. The envelope 2 containing the liquid sample is then placed on one layer or flap 12 of the protective enclosure 3 which, as seen in FIG. 4, is foldably connected to an upper layer or flap 13. The envelope is lightly secured to the enclosure by a number of adhesive dots 14 placed adjacent to the heat seal in proximity to the edges of the envelope. The adhesive dots 14 can be placed between the envelope and one or both flaps 12 and 13. The purpose of the adhesive dots is to hold the envelope in a supported condition in the enclosure with only a relatively weak attachment strength so that when the envelope is to be separated from the enclosure, the envelope can be pulled from the enclosure while remaining intact. It has been found particularly effective, for this purpose, to place the adhesive dots 14 in the narrow margin of the envelope between seal line 11 and the edges of the envelope.

In the assembled condition, the envelope is sandwiched between the flaps 12 and 13 and the flaps engage the envelope over a portion of its perimetral extent in order to leave the pocket 10 exposed through the cutout 4 while the remaining portion of the perimetral extent of the envelope represented by the edge 9 remains free and unsupported.

In order to remove the envelope from its protective enclosure, the user grasps the visible portion of the envelope, i.e. the pocket 10, and exerts a sharp pulling force to overcome the attachment provided by the adhesive dots 14 to release the envelope from the package. By virtue of the strength and flexibility of the material of the envelope, it is readily separable from the enclosure while remaining intact. In order to seal the flaps 12 and 13 of the protective enclosure and to permit the envelope to be removed from the enclosure by the aforesaid pulling action, the lower flap 12 can be coated with an adhesive in a region 15 surrounding the envelope. Any adhesive suitable for securing the material of the flaps of the enclosure can be employed. Moreover, the adhesive can be placed on either or both flaps.

After the envelope has been removed from the protective enclosure, the flap 7 can be peeled back as shown in FIG. 3 with sufficient force to open the heat seal 11 to provide access to the liquid sample within the pocket 10. Since the sample in liquid form is adsorbed on the envelope material in the pocket 10, it remains in place. The liquid sample is applied by using the envelope as an applicator or by transferring the sample from the envelope to the user by his or her finger.

Since the protective enclosure has a greater length and width than the envelope, it is possible to print indicia 16 on the package which can be of an informative or advertising nature.

FIG. 2 shows the arrangement of the envelope in the enclosure. In the illustrated embodiment, the thickness of the material of the enclosure is, 0.008" and the thickness of the film of the envelope is 0.002". Therefore, the total thickness of the package where the envelope is sandwiched between the flaps of the enclosure is 0.020". The liquid sample P and any accompanying air in the envelope causes the pocket 10 to have an overall thickness of about 0.016"–0.018". Hence, the thickness of the protective enclosure at surfaces 5 and 6 where it sandwiches the edge of the envelope is greater than the maximum overall thickness of the pocket and thereby the enclosure can protect the envelope from application of squeezing forces by intercepting these forces at surfaces 5, 6. Effectively, the surfaces 5, 6 extend around the sandwiched perimeter of the envelope and form a thickened rim around the cutout to protect the envelope against application of squeezing forces. This enables the package to be used as an insert card in a magazine. The envelope is held in co-planar relation with the enclosure by the mating flaps of the enclosure and will not be subjected to squeezing forces even when a large number of magazines are stacked one on top of the other, for example, during production and shipping. The recessed position of the envelope 2 with respect to the outer surfaces 5 and 6 of the protective enclosure make this possible. The envelope is further protected by the protective enclosure by maintaining the edge 9 of the envelope within the outline of the enclosure. In the drawing, the edge 9 of the envelope is rectilinear and is substantially coincident with the edge of the enclosure, but it is also possible for the edge of the envelope to be substantially recessed with respect to the edge of the protective enclosure. Instead of a rectilinear edge, the enclosure can have any other suitable shape.

If it is desired to supply a number of liquid samples which can be the same or different, the enclosure can be provided with a plurality of cutouts in which a respective envelope can be engaged. Alternatively, the pocket 10 can be divided into two chambers by providing a transverse seal line 11 across the pocket. In this way the same or different liquid samples can be incorporated in the respective chambers. In use, the user peels back the flap 7 to peel open the seal line bounding the first chamber to gain access to the liquid sample therein. After the liquid sample in the first chamber has been used, the remainder of the seal line can be unpeeled to expose the liquid sample in the second chamber.

In accordance with the invention, there has been provided a package 1 in which the flexible normally non-self-sustaining envelope 2 is supported with stability in the enclosure in a position in which the envelope is engaged over a portion of its perimetral extent while the remaining perimetral portion of the envelope is free and unsupported, the pocket 10 containing the liquid sample being confined in the cutout 4 in recessed relation below the outer surfaces 5, 6 so that the envelope is protected by the enclosure and is capable of being manually engaged to detach the envelope from the protective enclosure.

As illustrated, the package 1 is adapted for incorporation into a book, magazine or pamphlet by side wire binding or perfect binding in which edge 17 of the enclosure is affixed in the binding. Edge 17 is formed by aligned edges 18 and 19 of flaps 12 and 13. The package 1 can also be affixed by saddle wire binding by extending flap 12 beyond edge 18, as shown in dotted outline at 20 in FIG. 4, and forming a fold in the extended flap 12 at or near edge 18.

Although the invention has been described up to this point in relation to specific embodiments thereof and has been generally described with reference to liquid perfume samples, it will become apparent to those skilled in the art that numerous modifications and variations can be made as regards the composition of the enclosure, the liquid sample, and the envelope. For example, the liquid sample could be a medicament or reagent of a specific dosage useful for therapeutic or testing purposes.

Figure 5:
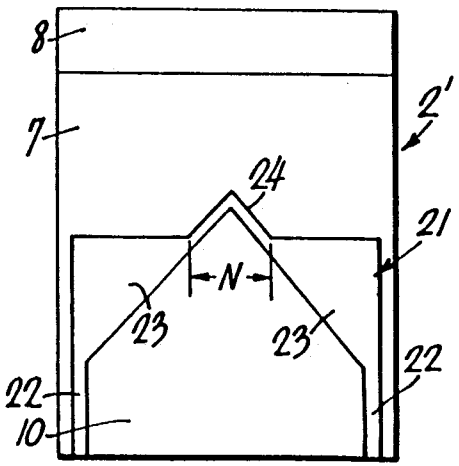
FIG. 5 is a plan view of another embodiment of an envelope suitable for a relatively viscous flowable product.

In the event that the sample is a flowable product such as a lotion, cream or paste, the envelope can be modified to permit discharge of the sample through a small calibrated passage by a squeezing action on the pocket. FIG. 5 shows an embodiment suitable for a flowable product, such as a lotion, cream or paste which is similar to FIG. 3 and in which the same reference characters are used to designate the same parts. In FIG. 5 there is seen an envelope 2' formed by folded flaps 7, 8 which are secured by a heat seal 21 formed by seal lines 22 which merge into relatively large triangular seal areas 23 from which extend seal lines forming a triangular peak 24.

The envelope 2' is mounted in the enclosure 3 in the same manner as described for the embodiment shown in FIG. 3, namely by means of adhesive dots and by being sandwiched between flaps 12 and 13 of the enclosure. When the envelope 2' is removed from the enclosure, access to the flowable product is obtained by lifting flap 7 away from flap 8 and forming an opening for the pocket 10 by peeling the flap 7 away from flap 8 at the peak 24. The opening will be formed at the base of peak 24 with a width N. The presence of the triangular seal areas 23 provides a resistance to the further separation of flap 7. Consequently, when the flap 7 is lifted, only the triangular peak 24 will be unpeeled and provide the outlet opening for the contents in pocket 10.

Figure 6:
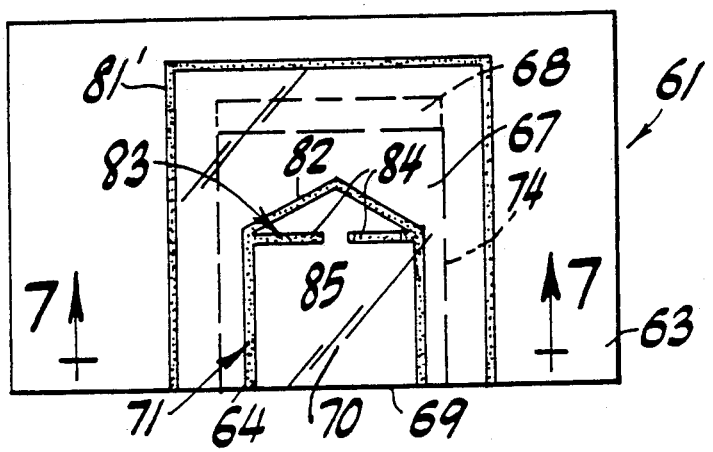
FIG. 6 is a plan view of another embodiment of a package according to the invention.
Figure 7:
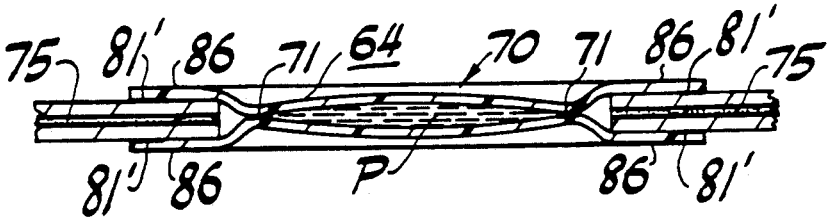
FIG. 7 is a sectional view on enlarged scale taken along line 7—7 in FIG. 6.
Figure 8:
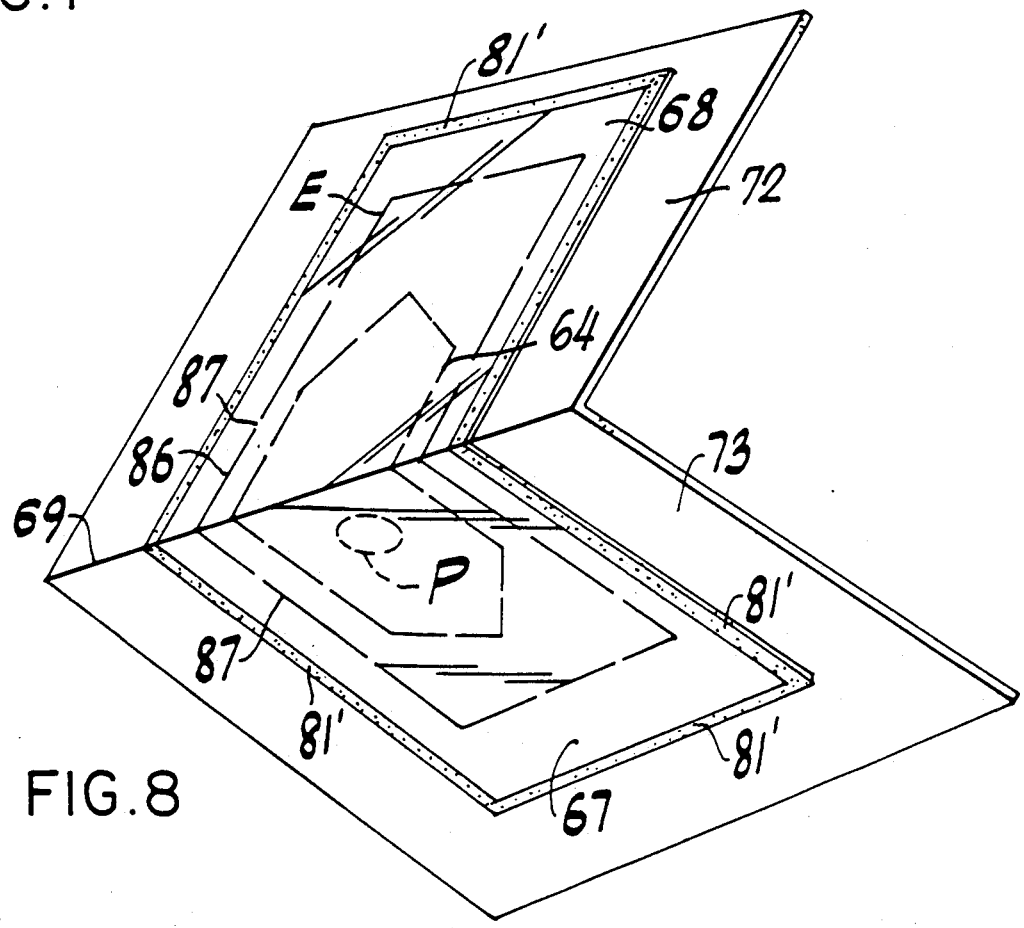
FIG. 8 is a perspective view on enlarged scale showing an intermediate stage in the assembly of the package in FIGS. 6 and 7.

FIGS. 6–8 show another embodiment of the invention in which the package 61 differs from that of the embodiments previously described in that instead of sandwiching the film material of the envelope between the flaps of the enclosure the film material is folded on and around the enclosure 63. Specifically flaps 67 and 68 of the film material are folded on and around flaps 72 and 73 of enclosure 63 so that the flaps 67 and 68 are disposed on the outer surfaces of flaps 72 and 73. The pocket 70 for the liquid sample is formed by heat sealing the film material along the seal line 71. The seal line is composed of spaced parallel legs 81 extending substantially perpendicularly to fold 69, a triangular peak 82 joined to legs 81 and a cross bar 83 formed by legs 84 which extend toward one another but leave a space 85 therebetween to form a discharge orifice.

The film material is secured to the enclosure 63 by a seal line 81' approximately at the periphery of the film material. Between the seal line 71 and the seal line 81' the film material is provided with a separation means constituted by a line of performations 74 extending in each flap of the film material from fold 69. The line of perforations is comprised of slits 86 extending completely through the thickness of the film material separated by regions 87 of intact material forming discrete connection regions. The outline of the separation means formed by slits 86 defines the envelope E which is separable from the enclosure at the time of use.

As in the previous embodiment, the overall thickness of the pocket 70 containing the liquid sample P is less than the overall thickness of the enclosure 63 so that the pocket is protected against the application of squeezing forces thereagainst.

In order to assemble the package 61, the film material is sealed at its outer periphery along seal line 81' to the outer surface of the flaps 72 and 73 of the enclosure 63. The separation means formed by the slits 86 and separations 87 is then formed in the film material. The sample P is thereafter deposited onto the film material of flap 67 which is affixed to flap 73 of the enclosure and thereafter the flap 72 together with the film material of flap 68 secured thereto is folded on fold line 69 to bring the flaps 72 and 73 into confronting relation and also to bring the flaps 67 and 68 of the film material into confronting relation through a cutout 64 in the enclosure 63. The flaps 67 and 68 are then secured together along seal line 71 to confine the sample P within pocket 70. An adhesive 75 is placed between flaps 72 and 73 before they are folded into confronting relation so that when they are brought into confronting relation they are adhesively secured together.

Figure 9:
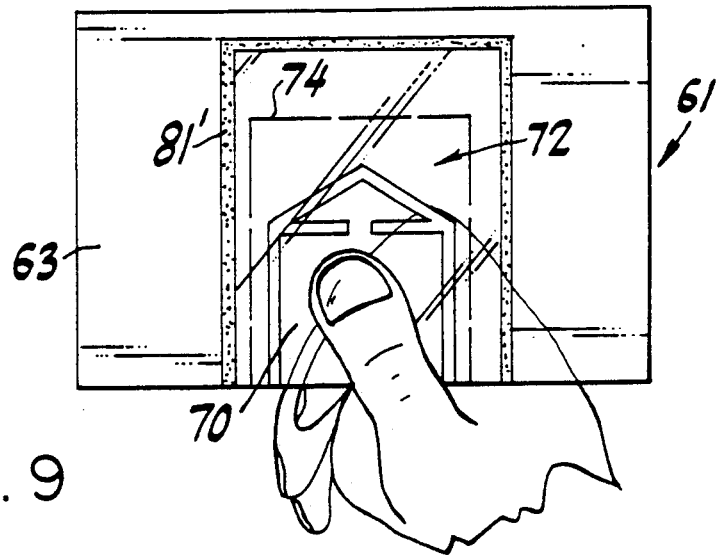
FIG. 9 shows a first stage in the removal of an envelope from the package in FIG. 6.
Figure 11:
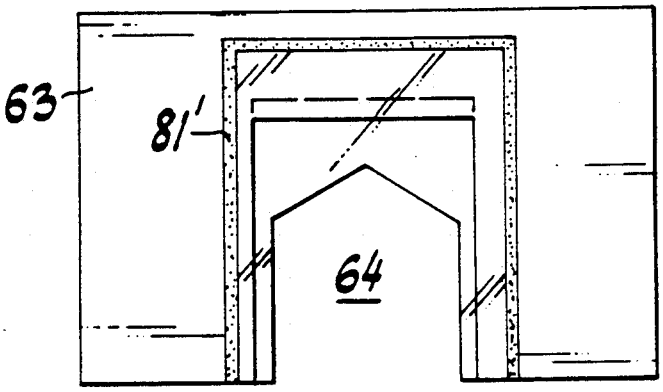
FIG. 11 is a perspective view of the separated envelope indicating its mode of opening.
Figure 10:
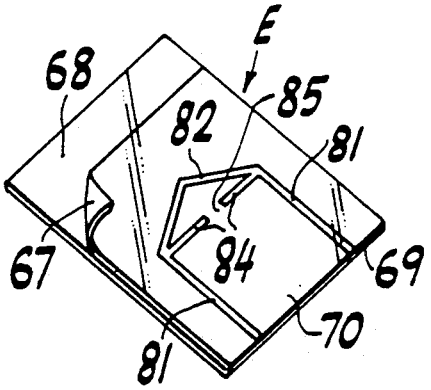
FIG. 10 shows the stage of separation of the envelope from the package.
Figure 10:
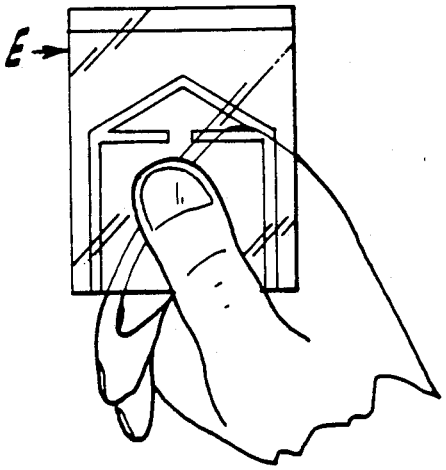

In order to separate the envelope E from the enclosure 63 the user grasps the pocket 70 which is exposed in the cutout 64 in the enclosure 63 in the manner as shown in FIG. 9. By applying a pulling force on the film material, the envelope E is separated from the remainder of the film material along the line of perforations 74. The amount of force necessary to effect the separation of the envelope from the remainder of the film material can be controlled by the spacing of the lines of perforations 86 and the length of the connecting regions 87. When the envelope E has been removed, it is in an intact sealed state as shown in FIG. 10. In order to open the pocket to gain access to the sample, the flap 67 is peeled away from the flap 68 through the triangular peak 82 until it meets the resistance of cross bar 84. At this stage the pocket 70 is open at space 85 which forms a nozzle through which the sample P in the pocket can be discharged by applying squeezing force to the pocket to expel the sample. This arrangement is particularly effective for samples of relatively low viscosity such as liquids. For samples of higher viscosity, such as pastes, the flap 67 can be peeled back to the fold 69 to expose the entire area of the pocket 70.

Figure 12:
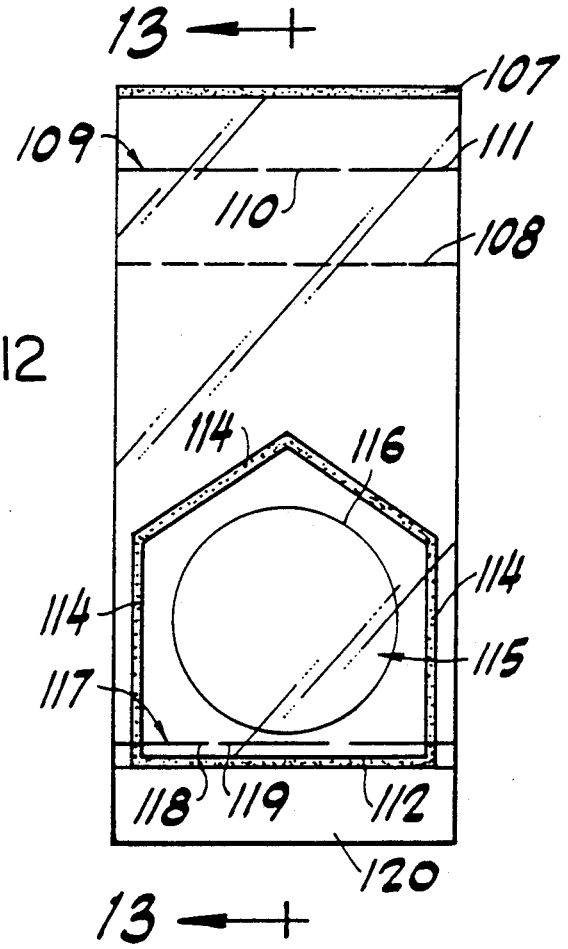
FIG. 12 is a plan view of another embodiment of a package according to the invention.
Figure 13:
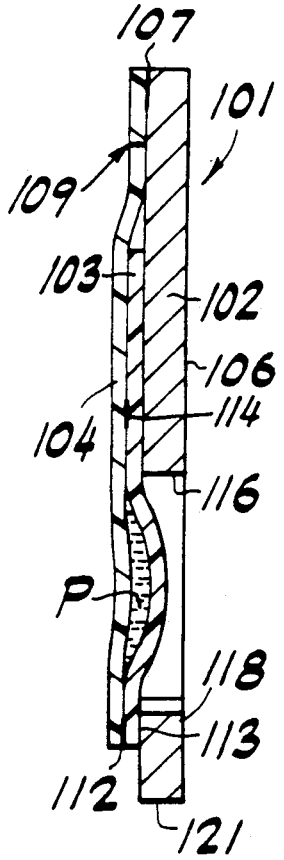
FIG. 13 is a sectional view taken on line 13—13 in FIG. 12.
Figure 14:
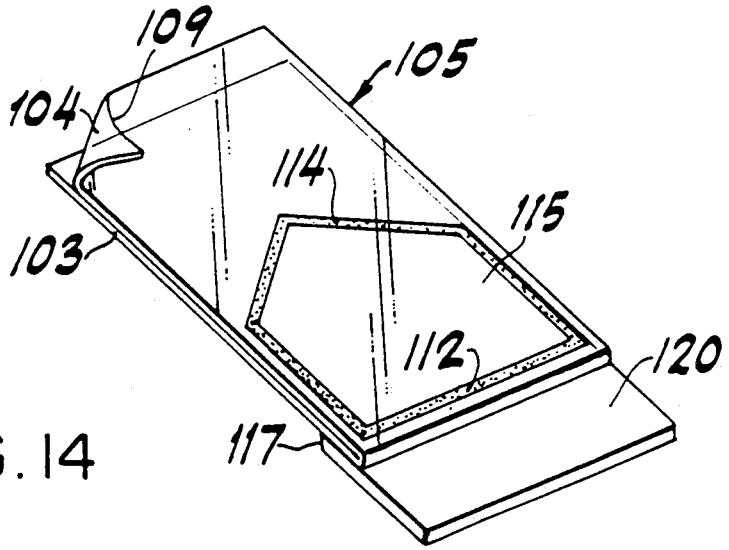
FIG. 14 is a perspective view showing the envelope of FIG. 12 separated from the package.

FIGS. 12–14 show another embodiment of the package of the invention and this embodiment differs from the previous embodiments in that the package is disposed on only one side of the substrate. In this embodiment there is seen a package 101 which comprises a substrate 102 of cardboard or like relatively rigid material on one surface of which are mounted two layers of thin flexible material 103 and 104 which form the envelope 105 shown in FIG. 14. The back surface 106 of the substrate 102 is bare and exposed. The layer 103 serves as an inner flap of the envelope 105 and the layer 104 serves as an outer flap, and the upper end of the outer flap 104 is sealed to the substrate 102 along a seal line 107. The seal line 107 can be formed by a heat seal between the outer flap 104 and the substrate 102. The seal line 107 is intended to be a permanent seal which fixes the outer flap 104 to the substrate. The inner flap 103 does not extend as far as the upper edge of the substrate, and terminates at a distance from the seal line 107. The upper edge of the inner flap 103 is shown at 108. Between the seal line 107 and the upper edge 108 of the inner flap 103, the outer flap 104 is provided with a line of perforations 109 formed by slits 110 separated by narrow gaps 111. When a downward pulling force is applied to the outer flap 104 below the line of perforations 109, the flap 104 will separate along the line of perforations 109. At their lower ends the flaps 103 and 104 are joined together by a seal 112 and at this location a seal 113 is formed between the substrate 102 and 103. Extending continuously from seal 112 is a seal 114 which joins the flaps 103 and 104 together to form a sealed pocket 115. The seal 114 allows separation of the flaps 103 and 104 by a peeling operation as explained in the previous embodiments. A quantity of liquid sample P is sealably contained in the pocket 115. The substrate 102 is formed with an opening or cutout 116 into which the pocket 115 containing the liquid sample P can be received so that no squeezing force will be developed on the pocket when an external force is applied to the package at the outer surface of the outer flap 104 as when a number of packages are stacked upon one another. The material of the flaps and the mounting of the film on the substrate is such that the pocket containing the liquid can be fully accommodated within the opening 116 so that squeezing pressure can not be applied to the pocket which could cause rupture of the seal 112, 114 and leakage of the liquid sample from the package.

At a location above the seal 112, the substrate 102 is provided with a line of perforations 117 consisting of slits 118 and intermediate gaps 119 therebetween. A tab 120 is formed in the substrate 102 between the line of perforations 117 and the lower edge 121 of the substrate. As in the previous embodiment, the envelope 105 is separated from the substrate with the pocket in an intact sealed state. This is achieved by manually engaging the tab 120 and applying a downward pulling force thereto to separate the substrate along perforation line 117 and the outer flap 104 from the substrate along perforation line 109. FIG. 14 shows the envelope 105 in its state of removal from the substrate. As in previous embodiments in order to gain access to the liquid sample within the pocket 155, the flaps 103 and 104 are peeled away from one another to open the seal line 114.

As in the previous embodiment, the overall thickness of the substrate 102 is greater than the thickness of the pocket consisting of the thickness of flaps 103 and 104 and the sample P in the pocket.

Figure 15:
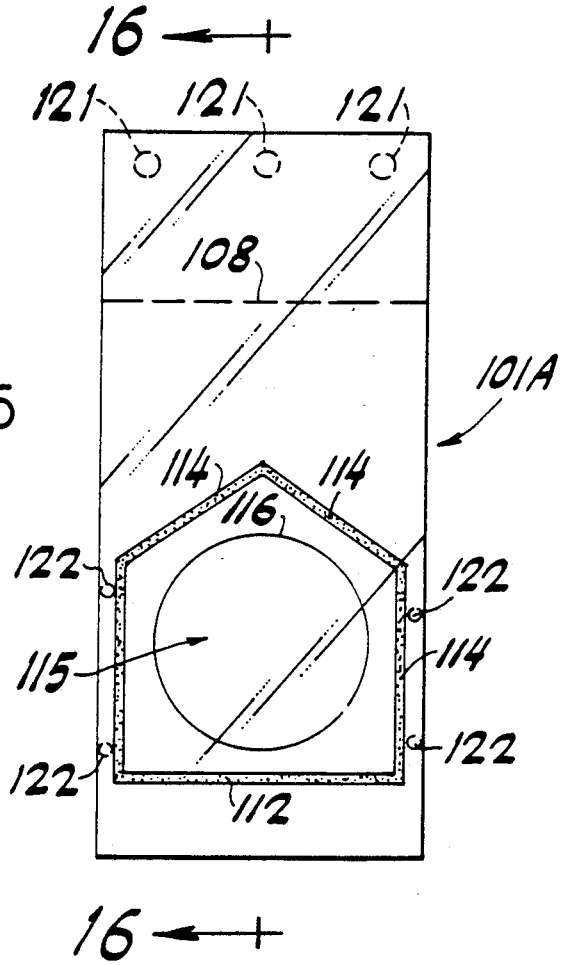
FIG. 15 is a plan view of a modified embodiment of FIG. 12.
Figure 16:
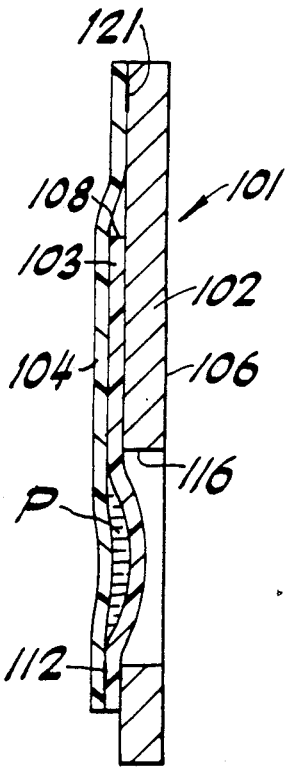
FIG. 16 is a sectional view taken on line 16—16 in FIG. 15.
Figure 17:
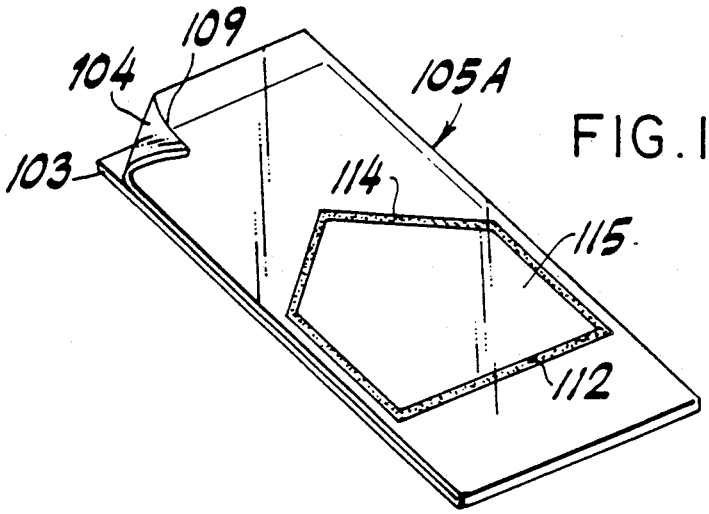
FIG. 17 is a perspective view showing the envelope of FIG. 15 separated from the package.
Figure 18:
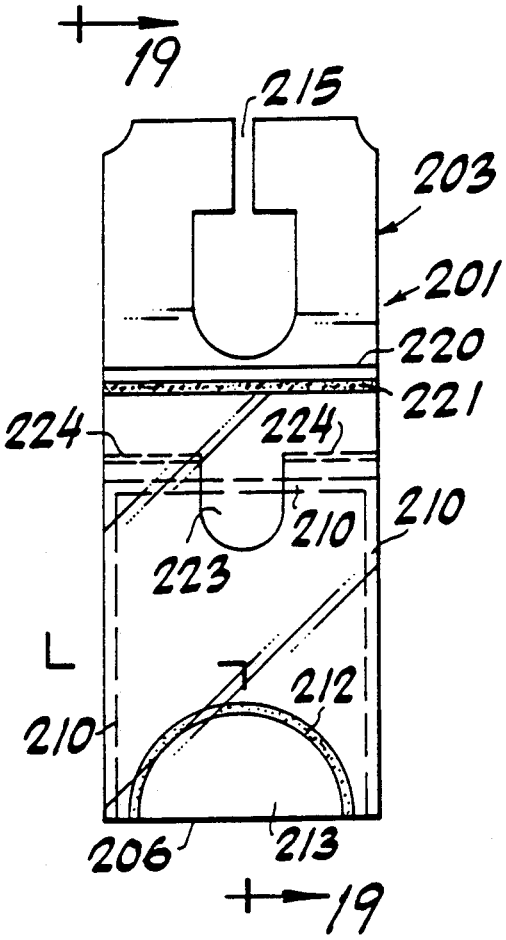
FIG. 18 is a plan view of another embodiment of a package according to the invention.

FIGS. 15–17 show a modification 101A of the embodiment of FIGS. 12–14 in which the need for lines of perforations in the film and in the substrate is avoided. The common elements are given the same reference characters and will not be discussed in detail. In FIGS. 15–17, the outer flap 104 is attached to the substrate 102 by small adhesive dots 121 near the upper end of the outer flap 104. The inner flap 103 is attached to the substrate by small adhesive dots 122 in the margin between seal line 114 and the sides of the substrate 102. The adhesive dots 121 and 122 serve as a detachable means between the envelope 105A and the substrate. In order to remove the envelope 105A from the substrate 102, the user engages the flaps 103, 104 below the seal line 112 or at the pocket 115 through opening 116 and applies a force to break the adhesive connection at adhesive dots 121 and 122 whereby the envelope 105A is now free of the substrate as shown in FIG. 17 and able to be opened in the manner previously described with reference to FIG. 14.

FIGS. 18–23 illustrate a further embodiment of the package according to the invention and this embodiment differs from the previously described embodiments in that instead of separating the envelope in intact sealed state from the relatively rigid substrate or support, this embodiment provides for the opening of the envelope in situ on the support. This embodiment is particularly adapted to samples of amorphic material in paste form such as lipstick.

In FIGS. 18–23 there is shown a package 201 which comprises a relatively rigid support means 203 formed as a substrate of cardboard or like material on which a flexible film material 202 is externally folded.

Figure 21:
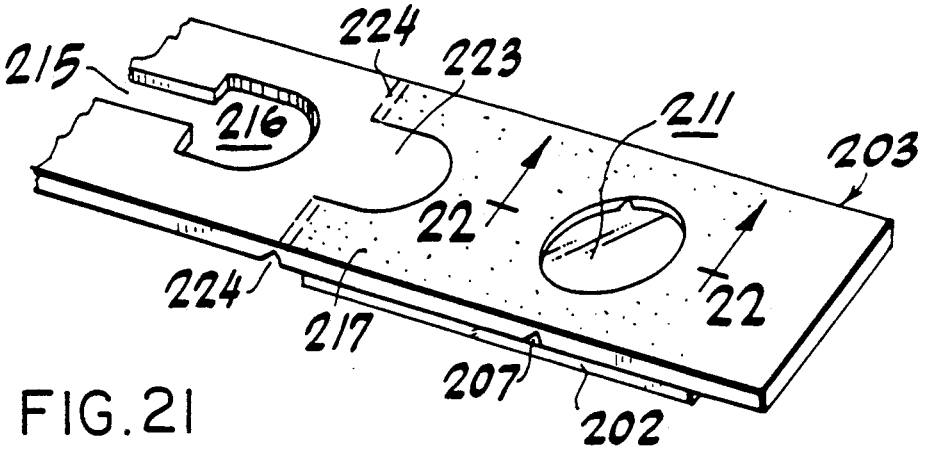
FIG. 21 is a perspective view on enlarged scale showing a first stage in the assembly of the package of FIG. 18.
Figure 22:
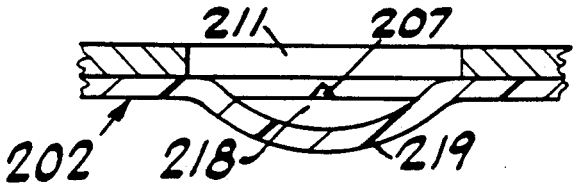
FIG. 22 is a sectional view on enlarged scale taken along line 22—22 in FIG. 21.
Figure 23:
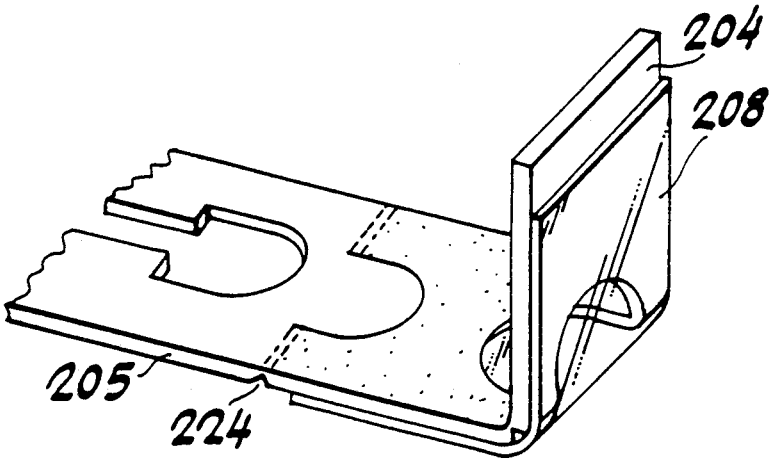
FIG. 23 shows a subsequent stage in the assembly of the package of FIG. 18.

More specifically, the substrate 203 is formed with overlapped flaps, which are folded around a fold line 206. The fold line 206 is determined by a V-shaped notch 207 formed in the thickness of the material of the substrate as shown in FIGS. 21 and 22. The flexible film material 202 which is constituted of a thin, transparent thermoplastic material, as described previously, has flaps 208 and 209 respectively jextaposed on flaps 204 and 205 of the substrate. The flap 208 is secured at its periphery to the flap 204 by a seal 210. The flap 209 is not secured to the flap 205 of the substrate and hence is free and disconnected. The substrate 203 is formed with a cutout 211 which is symmetrically located with respect to notch 207 and thereby with fold line 206. The cutout 211 is shown as a circular aperture in the substrate but this could be of other symmetrical shape such as an ellipse whose major axis extends in the length direction of substrate 203, i.e. perpendicular to notch 207.

The flaps 208 and 209 of the film material are secured together by a separable seal means 212 within the outline of the cutout 211. The seal means 212 defines pocket 213 which is visible through the cutout 211. Sealingly contained in the pocket 213 is a sample of material 214 which advantageously is in a thick paste state and is sufficiently cohesive to constitute an amorphic mass. In a preferred used, the material is a lipstick sample.

At the upper end of the substrate 203 there is formed a slot 215 which extends into a keyhole 216. The keyhole 216 is adapted to be engaged on a rod support (not shown) and to be releasable therefrom by pulling the package so that the rod support passes through slot 215. It is to be understood that the rod support is considerably more rigid than the substrate 203 so that the substrate can be deformed at slot 215 to allow it to be pulled from the rod support.

In order to assemble the package 201, the substrate 203 is initially supported in a flat unfolded state as shown in FIG. 21 with the flap 208 of the flexible film material secured around its periphery by seal 210 to the underside of the substrate. The sample 214 is deposited in the cutout 211 and rests on the surface of the film which is exposed through the cutout. The substrate and the film are then folded around notch 207 to bring the flap 204 of the substrate into confronting relation with the flap 205. An adhesive 217 is placed on the surface of the substrate corresponding to flap 205 so that when the substrate is folded, the flaps 204 and 205 will be joined together. Alternatively, the adhesive can be placed on flap 204 or on both flaps 204 and 205. As shown in FIG. 22, the film 202 can be formed with a recess 218 in order to form a well in the pocket which will permit a greater amount of sample to be accommodated in the pocket and be confined therein. As also shown in FIG. 22 the thickness of the material at the pocket can be increased to provide greater rigidity and provide for the confinement for the sample as shown at 219.

In order to open the pocket 213 to gain access to the sample, the free edge 220 of flap 209 is engaged by the user and pulled away from the substrate to break the seal 212 surrounding the pocket 213. In order to help the user to find the edge 220 of the flap, a band 221 of dark contrast outline or other suitable indicia means is placed adjacent to edge 220. After flap 209 has been peeled back to open the seal means 212, the user can apply his or her finger to the sample of material 214 now exposed at the pocket 213 to utilize the sample. The arrangement of flap 209 as a free disconnected flap on the substrate allows the package to be opened in a particularly simple and unobstructed fashion. Prior to opening, the flap 209 remains in contact with the substrate due to the seal means 212 which has the effect of biasing the flap 209 towards the substrate 203. It has also been found that the thin film of material of flap 209 tends to remain attracted to the substrate due to static electricity. This is particularly the case if the substrate is formed with a conventional relatively polished clay surface. The static electricity is generally sufficient so that even after the seal has been opened, the flap 209 can be brought into contact with the substrate and retained thereon.

Figure 20:
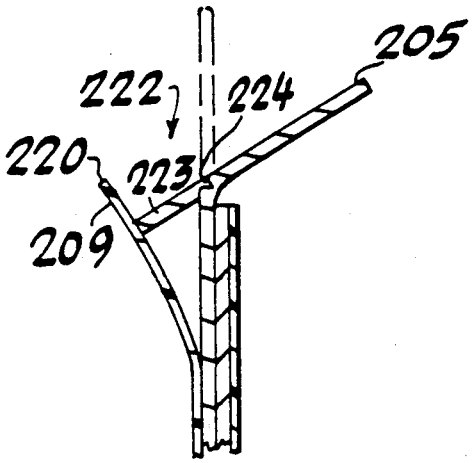
FIG. 20 shows a portion of the package of FIG. 19 in a condition in which the package is ready to be opened.
Figure 19:
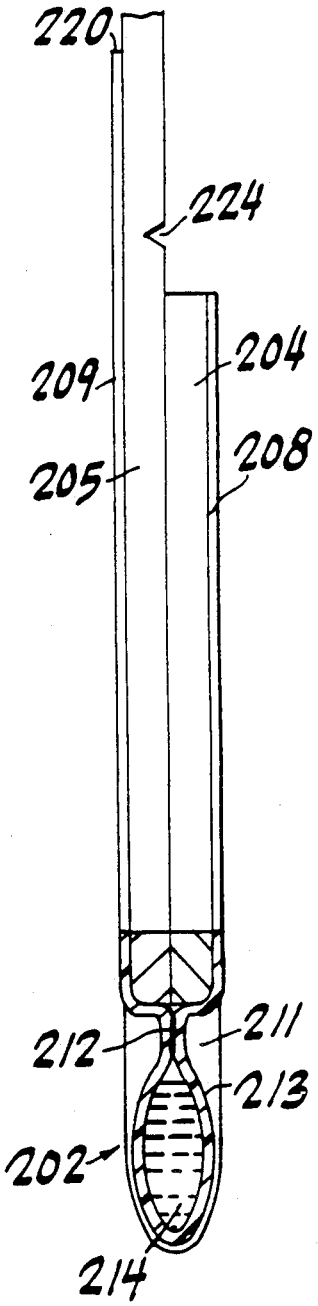
FIG. 19 is a sectional view on enlarged scale taken on line 19—19 in FIG. 18.

In order to facilitate the separation of the flap 209 from the substrate and to overcome the static electric attraction between the film and the substrate, a push means 222 is provided on the substrate. The push means 222 comprises a push tab 223 integrally formed in the flap 205 of the substrate and the push tab 223 is normally contained with the plane of the flap 205. The flap 205 is provided with grooves 224 extending from the edges of tab 223 to the lateral edges of the substrate. The grooves 224 define a hinged fold line in the flap 205. In order to activate the push means 222, the flap 205 is bent around the fold line 224 which causes the push tab 223 to displace the end of flap 209 away from the substrate as shown in FIG. 20. This will facilitate the engagement of the flap 209 by the user to open the pocket. It is to be noted in FIGS. 21 and 22 that adhesive 217 is deliberately omitted from the push tab 223 in order not to interfere with the pivotal movement of the push tab 223 for displacing the free edge of the flap 209 away from the substrate.

As in the previous embodiments, the combined thickness of the pocket 202 comprised of the two thicknesses of the film and the sample is less than the overall thickness of the flaps 204, 205 of the substrate in order to provide protection for the sample in the pocket against application of crushing force.

Instead of forming the substrate by folding two flaps in confronting relationship, it is also possible to make the substrate as a single member and to form the opening 211 as a cutout in one edge of the substrate. The flexible film material will then be folded on and around the substrate at the edge with the cutout.

Although the embodiment of FIGS. 18-23 has been described with reference to a sample material such as lipstick, the package is suitable for use with other amorphic materials such as powders, eye shadow, and rouge.

The pushtab 223 on flap 205 can be omitted and the grooves 224 can extend along the entire width of the substrate below the edge 220 of flap 209. When the flap 205 is bent as shown in FIG. 20, the free edge 220 of the flap 209 will then be freely exposed for engagement by the user.

What is claimed is:

1. A package for a liquid sample comprising a sealed envelope including a pocket containing a liquid sample, relatively rigid support means engaging said envelope around at least a portion of the periometer thereof and providing an opening in which the pocket of the envelope including the liquid sample is received in recessed relation below outer surfaces of the support means and means permitting separation of said envelope from said support means in intact sealed state by application of force to said envelope at said opening, said flexible envelope comprising a film material which extends on and around said relatively rigid support means.

2. A package as claimed in claim 1 wherein said separating means comprises detachable connection means in said film material.

3. A package as claimed in claim 2 wherein said detachable connection means comprises a separation means formed by a line of perforations in said film material separated by discrete connection regions.

4. A package as claimed in claim 3 wherein said line of perforations comprises a slit in said film material.

5. A package as claimed in claim 1 comprising means fixedly joining said film material to said rigid support means around said portion of the perimeter of said envelope.

6. A package as claimed in claim 5 wherein said means for separating said envelope from said support means is disposed between said pocket and the means fixedly joining said film to said rigid support means.

7. A package as claimed in claim 1 wherein said film material is a transparent plastic material.

8. A package as claimed in claim 1 wherein said support means has an opening across which said envelope extends.

9. A package as claimed in claim 8 wherein said opening is a cutout in said support means.

10. A package as claimed in claim 9 wherein said support means has a perimetral outline within which said envelope is confined.

11. A package as claimed in claim 1, said envelope including openable sealing means defining said pocket.

12. A package as claimed in claim 1, said envelope including openable sealing means which, when opened provides an opening of determined size through which the liquid sample can be discharged.

13. A package as claimed in claim 1 wherein said film material is folded on and around said support means.

14. A package for a sample of material comprising relatively rigid support means, flexible material supported by said rigid support means, said support means having an opening, said flexible material including two flaps, separable seal means joining said two flaps of said flexible material for defining a sealed pocket which is exposed in said opening, a sample of material in said pocket, one of said flaps of said flexible material, being secured to said support means, the other flap being free and disconnected from said support means for being pulled away from said support means for separating said seal means to open said pocket and expose the sample of material while said one flap remains fixed to said support means.

15. A package as claimed in claim 14, wherein said flexible material is folded externally on said rigid support means such that said one flap is juxtaposed with a second surface of said support means.

16. A package as claimed in claim 15 wherein said rigid support means comprises a flat member having an edge with a cutout therein which forms said opening, said flexible material being folded around said edge with said pocket being positioned in said cutout.

17. A package as claimed in claim 16 wherein said seal means joins the two flaps of flexible material along a line which conforms to said cutout.

18. A package as claimed in claim 17 wherein said cutout is curved.

19. A package as claimed in claim 17 wherein said other flap can be pulled away from said flat member into a plane in common with said one flap, said sample then being contained on said flexible material partly within said cutout and partly on said other flap.

20. A package as claimed in claim 19 wherein said other flap has an edge with indicia means proximate thereto for facilitating engagement of said edge of said other flap for pulling the same away from said flat member.

21. A package as claimed in claim 14 wherein said sample of material is an amorphic material selected from the group consisting of lipstick, powder, eye shadow and rouge.

22. A package as claimed in claim 16 wherein said flat member has an edge opposite said edge with the cutout and comprises an opening with a slot which permits said flat member to be engaged on a rod support and to be releasable therefrom by pulling said flat member so that the rod support passes through said slot.

23. A package as claimed in claim 14 wherein said flexible material is a transparent plastic film.

24. A package as claimed in claim 14 wherein said flexible material and said sample have a combined thickness at said opening in said rigid support means which is less than the thickness of said support means.

25. A package as claimed in claim 15 wherein said rigid support means extends beyond said other flap and has a fold line proximate the edge of said other flap and includes push means for displacing the edge of said other flap away from said support means when said rigid means is folded on said fold line.

26. A package as claimed in claim 15 wherein said rigid support means extends beyond said second flap and has a groove therein proximate an edge of said other flap to permit said rigid support means to be folded around said groove and expose said edge of the flap.

27. A package as claimed in claim 15 comprising second seal means sealing said one flap to said first surface of the rigid support means.

28. A package as claimed in claim 15 wherein said flexible material has a recess in at least one of said flaps to form a well in said pocket.

29. A package for a liquid sample comprising a flexible envelope including a sealed pocket containing a liquid sample, relatively rigid support means engaging said envelope around at least a portion of the perimeter thereof and providing an opening in which the pocket of the envelope including the liquid sample is receivable in recessed relation below outer surfaces of the support means, and means permitting separation of said envelope from said support means in intact sealed state by application of force to said envelope, said flexible envelope comprising two flaps and seal means sealably joining said flaps together to form said pocket.

30. A package as claimed in claim 29 comprising further seal means joining said envelope to said support means such that said envelope is juxtaposed on one of said surfaces of the support means, the other surface being bare and exposed.

31. A package as claimed in claim 30 wherein said means permitting separation of said envelope from said support means comprises perforation means in one of said flaps which permits separation of said one flap at said perforation means.

32. A package as claimed in claim 31 comprising another seal means joining the envelope to the support means and further perforation means in said support means at a location which permits separation of said support means at said further perforation means to form a pull tab which remains secured to the envelope when the latter is separated from the support means.

33. A packaging method comprising:

sealing a sample of material in a pocket of a flexible material which has one flap affixed to a rigid support means and a second flap in juxtaposed relation with said one flap, said pocket being formed by sealing said juxtaposed flaps, said pocket being located at an opening which is formed in said rigid support means, and opening said pocket to gain access to said sample by displacing said second flap away from said first flap to break the seal around the pocket while said one flap remains affixed to said rigid support means.

34. A packaging method as claimed in claim 33 comprising forming the rigid support means with a thickness around said opening which exceeds the combined thickness of the pocket including the sample of material therein.

35. A packaging method as claimed in claim 34 comprising folding said flexible material on and around the rigid support means so that said flaps are juxtaposed on respective opposite surfaces of the rigid support means and at said opening said flaps are disposed in confronting relation to one another.

* * * * *